US005713515A

United States Patent [19]

Adams et al.

[11] Patent Number: 5,713,515

[45] Date of Patent: Feb. 3, 1998

[54] METHOD AND SYSTEM IN A FLUID HEATING APPARATUS FOR EFFICIENTLY CONTROLLING COMBUSTION

[75] Inventors: Charles L. Adams, Fort Worth; Richard C. Adams, North Richland Hills, both of Tex.

[73] Assignee: PVI Industries, Inc., Fort Worth, Tex.

[21] Appl. No.: 567,471

[22] Filed: Dec. 5, 1995

[51] Int. Cl.[6] ..... F23N 1/08; G05D 15/00

[52] U.S. Cl. ..... 236/20 R; 165/256; 165/288; 236/1 EB

[58] Field of Search ..... 236/1 EB, 1 A, 236/1 H, 20 R, 91 F; 165/288, 256; 431/12; 126/351

[56] References Cited

U.S. PATENT DOCUMENTS

| | | | |
|---|---|---|---|
| 3,499,483 | 3/1970 | Schrader | 236/1 EB |
| 4,064,698 | 12/1977 | Stern | 60/644 |
| 4,199,690 | 4/1980 | Meyer | 236/1 EB |
| 4,408,569 | 10/1983 | Novak | 122/448 R |
| 4,834,284 | 5/1989 | Vandermeyden | 236/20 R |
| 4,913,128 | 4/1990 | Adachi | 126/351 |
| 5,400,962 | 3/1995 | Adams et al. | 236/20 R |

*Primary Examiner*—William E. Wayner
*Attorney, Agent, or Firm*—Charles D. Gunter, Jr.

[57] ABSTRACT

In a fluid heating apparatus having a fluid tank, a combustion chamber communicating with the fluid tank for heat exchange, and a combustible fluid delivery system coupled to the combustion chamber, a plurality of valves are individually configured in either an off-state or an on-state for delivering combustible fluid to the combustion chamber. Depending on the configuration of the multiple valves, the rate at which combustible fluid is supplied to the combustion chamber may be varied in response to a heat demand signal. Individual valve signals are generated for each of the multiple valves in response to the heat demand signal to place the multiple valves in a configuration to supply combustible fluid at predetermined rates. The demand signal is calculated in response to reading temperature at an inlet temperature probe and an outlet temperature probe, wherein the outlet temperature probe is located nearer a fluid outlet from the fluid tank than is the inlet temperature probe. The heat demand signal may also be a function of the excess of a set point temperature over a temperature measured by the outlet temperature probe. An airblower may also be coupled to the combustion chamber and operated in a plurality of modes for supplying air at a plurality of rates in response to the heat demand signal. The rates of air supply provided by the air blower are selected to supply air at a stoichiometric rates in relation to the fuel supply rates provided by various configurations of the valves in the combustible fluid delivery system.

10 Claims, 4 Drawing Sheets

METHOD AND SYSTEM IN A FLUID HEATING APPARATUS FOR EFFICIENTLY CONTROLLING COMBUSTION

BACKGROUND OF THE INVENTION

1. Technical Field

The present invention relates in general to an improved gas, oil, or gas/oil fired water heater or boiler and in particular to an improved method and system for efficiently controlling combustion in a gas, oil, or gas/oil fired water heater or boiler of the type having an internal combustion chamber for supplying heat to the closed tank interior of the device.

2. Description of the Related Art

Water heaters or boilers employing forced draft burners have used control systems for continuously varying fuel and airflow in response to variations in demand for hot water from the water heater. For example, U.S. Pat. No. 5,400,962 to Adams et al. (Adams '962) teaches a water heater that continuously varies the flow of combustible fluid and airflow in response to a heating demand signal. In Adams '962, two parallel gas valves are used to control the flow of gas in response to receiving an analog gas valve control signal. One of the two valves is larger in capacity than the other and is used for gross flow control, while the other smaller capacity valve is used for fine control of gas flow. Most significant bits of a gas flow signal are applied to a digital to analog converter to produce the analog gas valve control signal for controlling the larger capacity valve. Least significant bits of the gas flow signal are converted in a digital to analog converter for providing an analog gas valve control signal for the fine flow control valve.

Disadvantages of such analog control of gas flow include inaccurate flow metering resulting from nonlinear operation of the analog flow control valve, and the greater expense of digital to analog converters and analog flow control valves. Because of this, the control circuit for the analog flow control valves was more complicated and there was the possibility that the control system could lose track of the position of the analog flow control valves. Furthermore, the response in opening and closing the analog flow control valves was slow.

SUMMARY OF THE INVENTION

It is therefore one object of the present invention to provide an improved method and system for heating fluid.

It is another object of the present invention to provide an improved method and system for controlling combustion in a water heater.

It is yet another object of the present invention to provide a method and system that provides combustible fluid delivery at various rates with a cheaper, faster, and less complicated control system.

The foregoing objects are achieved as is now described. In a fluid heating apparatus having a fluid tank, a combustion chamber communicating with the fluid tank for heat exchange, and a combustible fluid delivery system coupled to the combustion chamber, a plurality of valves are individually configured in either an off-state or an on-state for delivering combustible fluid to the combustion chamber. Depending on the configuration of the multiple valves, the rate at which combustible fluid is supplied to the combustion chamber may be varied in response to a heat demand signal. Individual valve signals are generated for each of the multiple valves in response to the heat demand signal to place the multiple valves in a configuration to supply combustible fluid at predetermined rates. The demand signal is calculated in response to reading temperature at an inlet temperature probe and an outlet temperature probe, wherein the outlet temperature probe is located nearer a fluid outlet from the fluid tank than is the inlet temperature probe. The heat demand signal may also be a function of the excess of a set point temperature over a temperature measured by the outlet temperature probe. An airblower may also be coupled to the combustion chamber and operated in a plurality of modes for supplying air at a plurality of rates in response to the heat demand signal. The rates of air supply provided by the air blower are selected to supply air at a stoichiometric rates in relation to the fuel supply rates provided by various configurations of the valves in the combustible fluid delivery system.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
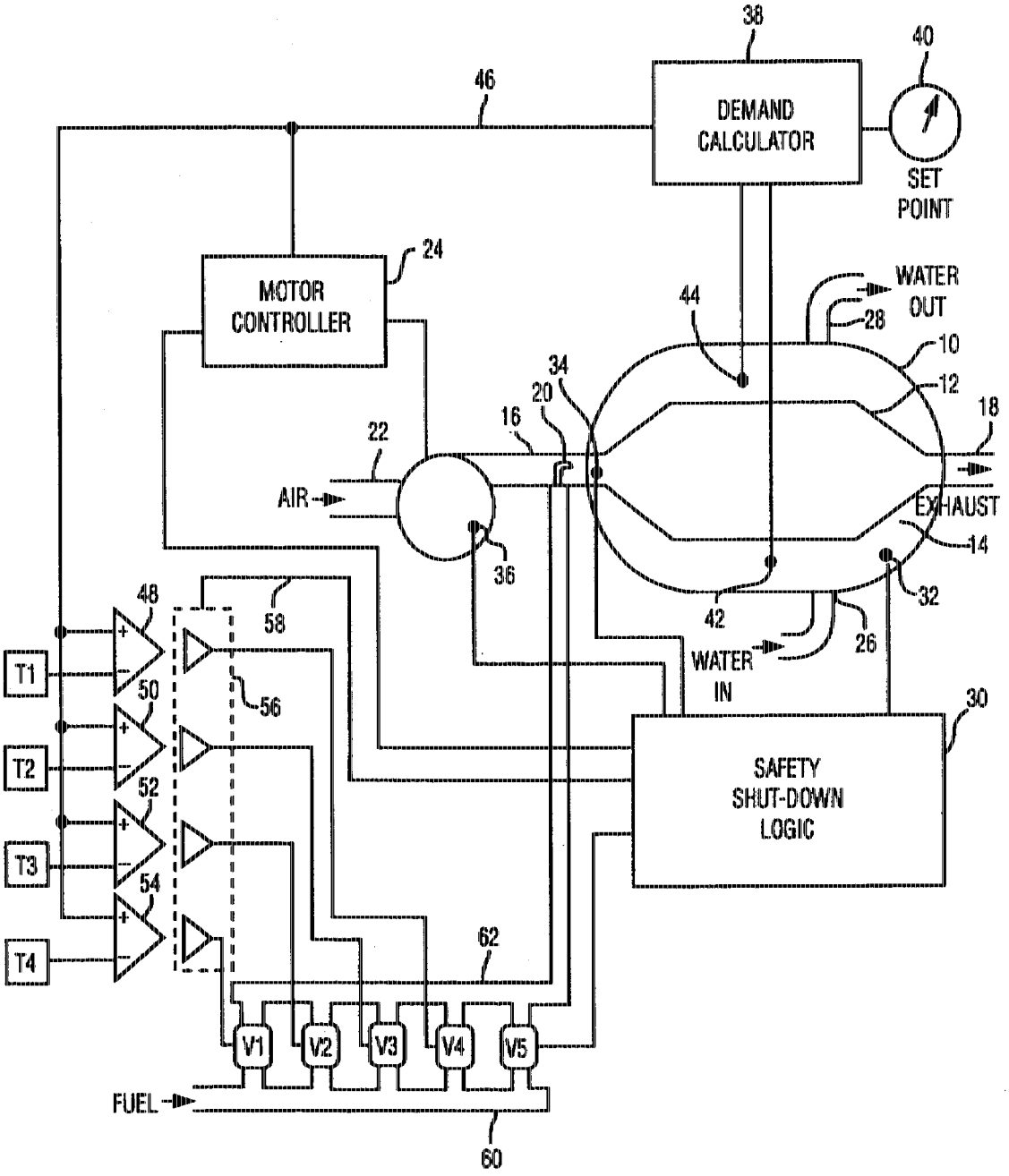
FIG. 1 depicts a schematic view of a fluid heating apparatus in accordance with the method and system of the present invention.

With reference now to the figures, and in particular to FIG. 1, there is depicted a schematic illustration of a fluid heating apparatus in accordance with the method and system of the present invention. In the embodiment shown, the fluid heating apparatus is a water heater suitable for commercial or residential use, although other fluids may be heated in accordance with the method and system of the present invention. The invention has application to other gas, oil and gas/oil fired appliances. In this discussion, the term "water heater" will be understood to encompass both water heaters and "boilers" of the type utilized for commercial/industrial use, as well as for residential use.

As shown in FIG. 1, fluid tank 10 is in communication with combustion chamber 12 for heat exchange with water 14. Combustion chamber 12 includes air opening 16 for passing air into combustion chamber 12, and exhaust opening 18 for removing combustion byproducts. One or more burner nozzles 20 are positioned with respect to combustion chamber 12 for supplying a combustible fluid, such as natural gas, to combustion chamber 12. Airblower 22 may be coupled to air opening 16 to provide air at a higher rate, wherein such a rate may be controlled by motor controller 24 which controls a motor in airblower 22.

Fluid tank 10 also includes water inlet 26 for receiving unheated water and water outlet 28 for removing heated water. Typically, water inlet 26 is located in a lower portion of fluid tank 10, while water outlet 28 is located in an upper portion of fluid tank 10 to take advantage of the fact that water 14 stratifies in fluid tank 10, which makes it more efficient to remove heated water from the top of fluid tank 10.

Safety shut-down logic 30 monitors several aspects of the operation of the fluid heating apparatus that are critical for safe operation. Such operational aspects include monitoring the water level in fluid tank 10 with low water detector 32, monitoring the presence of the flame in combustion chamber 12 with flame sensor 34, and monitoring the operation of airblower 22 with motor speed monitor 36. Low water detector 32 is coupled to fluid tank 10 in a manner that allows the detection of an unsafe low water condition. Flame sensor 34 may be implemented with a flame safeguard control sold under the trademark "FIREYE MC 120" by Electronics Corporation of America. In response to detecting a flame-out condition with flame sensor 34, the fuel supply to burner nozzle 20 is shut off and airblower 22 is allowed to purge combustion chamber 12 of unburned fuel. Motor speed monitor 36 is used to detect proper operation of airblower 22. For example, if motor speed monitor 36 determines that airblower 22 is not operating properly during a combustion chamber purge operation, a flame re-ignition procedure may be halted to avoid a potential explosion in the combustion chamber 12 or in the exhaust system.

As part of the system that regulates water temperature at water outlet 28, demand calculator 38 calculates a current demand for combustible fluid or fuel that is necessary to provide water at a desired temperature at water outlet 28. Demand calculator 38 receives input signals from set point input means 40, input temperature probe 42, and output temperature probe 44.

Set point input means 40 is used to receive a set point temperature from a user and provides a signal that indicates the desired water temperature at water outlet 28. Set point input means 40 may provide an analog signal or a digital signal to demand calculator 38. Any suitable interface with the user may be provided for entering a set point temperature, such as, for example, an electronic keypad or a mechanically operated switch or dial.

Input temperature probe 42 and output temperature probe 44 are both located in fluid tank 10 for sensing water temperature at two different locations. Input temperature probe 42 is not necessarily located in water inlet 26, but is located closer to water inlet 26 than is output temperature probe 44. Similarly, output temperature probe 44 is located closer to water outlet 28 than is temperature inlet probe 42. Thus, input temperature probe 42 may be considered "upstream" from probe 42. Thus, input temperature probe 42 may be considered "upstream" from output temperature probe 44 relative to the flow of water through fluid tank 10. Preferably, both input temperature probe 42 and output temperature probe 44 are located in a location where some mixture of newly input water with stored water has occurred. Such temperature probes may also be located to read water temperature in different strata within fluid tank 10.

Demand calculator 38 produces heat demand signal 46 in response to: (1) the difference between temperatures measured at input temperature probe 42 and output temperature 44; and (2) the difference between a temperature set at set point input means 40 and a temperature measured at output temperature probe 44. Such a heat demand calculation is described in further detail below with reference to FIG. 4. Heat demand signal 46 may be either a digital signal or an analog signal that represents a current fuel demand for maintaining a desired water temperature at water outlet 28.

Heat demand signal 46 is coupled to motor controller 44 and comparators 48 through 54. Comparator 48 compares heat demand signal 46 to a preselected threshold demand T1 and produces a valve signal for opening or closing gas valve V2. Comparator 50 compares heat demand signal 46 with preselected threshold demand T2 to produce a valve signal for opening or closing gas valve V3. Comparator 52 compares heat demand signal 46 with preselected threshold demand T3 to produce a valve signal for opening or closing gas valve V4. Comparator 54 compares heat demand signal 46 with preselected threshold demand T4 to produce a valve signal for opening and closing gas valve V5. In order to provide a means for quickly closing gas valves V2 through V5, all valve signals for V2 through V5 pass through gates 56 which are enabled and disabled by enable signal 58 from safety shut-down logic 30. Therefore, in order to shut down gas valves V2 through V5 safety shut-down logic 30 sends an appropriate enable signal 58 to gates 56 which causes valve signals for valves V2 through V5 to immediately have a closed signal state that causes valves V2 through V5 to completely close. As shown in FIG. 1, gas valve V1 may be separately controlled by safety shut-down logic 30 so that gas valve V1 may be opened during startup or during a re-ignition procedure.

Gas valves V1 through V5 provide a regulated flow of combustible fluid or gas to one or more burner nozzles, such as burner nozzle 20. The flow rate through gas valves V1 through V5 may be selected to be the same or different flow rates. For example, in a preferred embodiment, the flow rate through gas valve V1 is selected to provide fuel at a rate necessary to maintain a water temperature in fluid tank 10 when there is no demand for hot water at water outlet 28. Gas valves V2 through V5 may be significantly larger than V1 and supply gas at a much higher rate. In a preferred embodiment of the present invention, gas valve V1 supplies gas at the rate of 0.67 cubic feet per minute, or 40,000 BTU per hour for natural gas. Gas valves V2 through V5 provide gas at the rate of 5 cubic feet per minute, or 300,000 BTU per hour for natural gas.

In the embodiment shown in FIG. 1, gas valves V1 through V5 are connected in parallel between input manifold 60 and output manifold 62. Output manifold 62 is then connected to one or more burner nozzles 20. In an alternative embodiment, gas valves V1 through V5 may each be separately connected to a burner nozzle 20 in or near combustion chamber 12.

Figure 2:
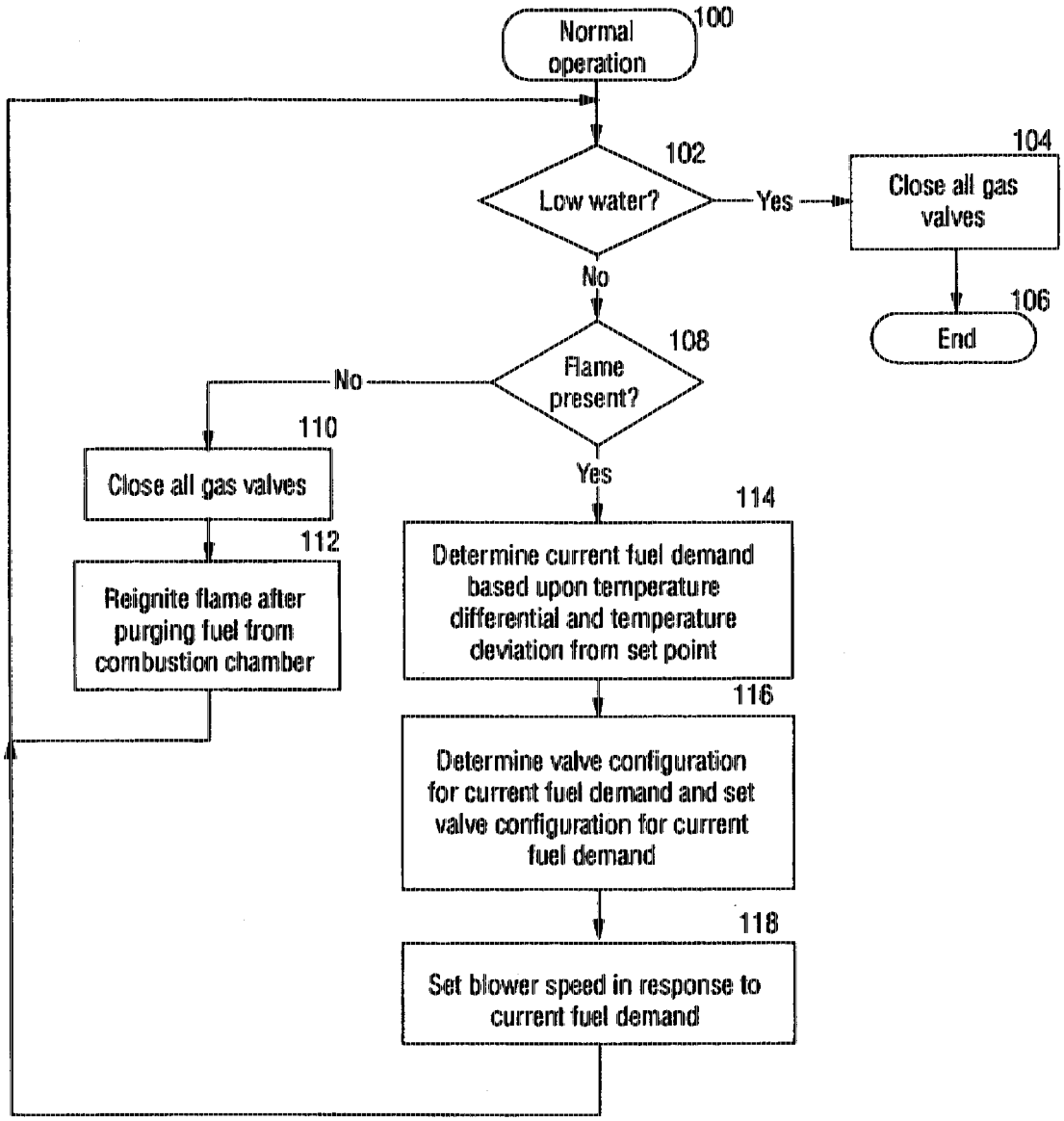
FIG. 2 is a high-level flowchart of the method of operating the heating apparatus of FIG. 1 in accordance with the method and system of the present invention.

With reference now to FIG. 2, there is depicted a high-level flowchart illustrating normal operation of the fluid heating apparatus in accordance with the method and system of the present invention. As illustrated, the process begins at block 100 and thereafter passes to block 102 wherein the process determines whether or not a low water condition exists. If a low water condition exists, all gas valves are closed to shut down the system, as depicted at block 104. Thereafter, the process ends at block 106.

If a low water condition does not exist, the process determines whether or not a flame is present in combustion chamber 12 (see FIG. 1), as depicted at block 108. If a flame is not present, a hazard condition exists and all gas valves are closed, as illustrated at block 110. After closing all the gas valves, the process attempts to reignite the flame after purging stray fuel from the combustion chamber, as depicted at block 112. Such a re-ignition and purging operation may be controlled by combinatorial logic, a state machine, or software in safety shut-down logic 30 (see FIG. 1). After completing such purging and re-ignition process, the process returns to block 102 to continue normal operation.

Referring again to block 108, if a flame is present, the process determines the current fuel demand based upon: (1) a temperature differential between input temperature probe 42 and output temperature probe 44; and (2) a temperature deviation from set point, as illustrated at block 114. Such a current fuel demand may be calculated in demand calculator 38, as shown in FIG. 1. This demand calculation is described in further detail with reference to FIG. 4 below.

Next, the process determines a valve configuration responsive to the current fuel demand and sets the valve configuration, as depicted at block 116. A valve configuration may be defined as a possible combination of completely open and completely closed valves in the group of valves V1 through V5 shown in FIG. 1. Such valve configurations are selected in response to the relationship between the current fuel demand and one or more preselected threshold demands. The process of determining and setting a valve configuration is described in further detail with reference to FIG. 3 below.

Next, the processor sets the airblower speed in response to the current fuel demand, as illustrated at block 118. Such an airblower speed will also correspond to a valve configuration providing a flow rate of fuel, wherein the airblower speed provides air at a stoichiometric rate in relation to the fuel supply rate. Because the airblower has a finite response time to a signal to change speeds, the signal to change the blower speed must be timed appropriately in relation to the signals to open or close the gas valves. Typically, a signal to adjust the airblower speed is sent to airblower 22 before signals are sent to valves V1 through V5 to adjust fuel flow.

Once the valve configuration and airblower speed have been adjusted in response to the current fuel demand, the process returns to block 102 to continue controlling the operation of the fluid heating apparatus.

Figure 3:
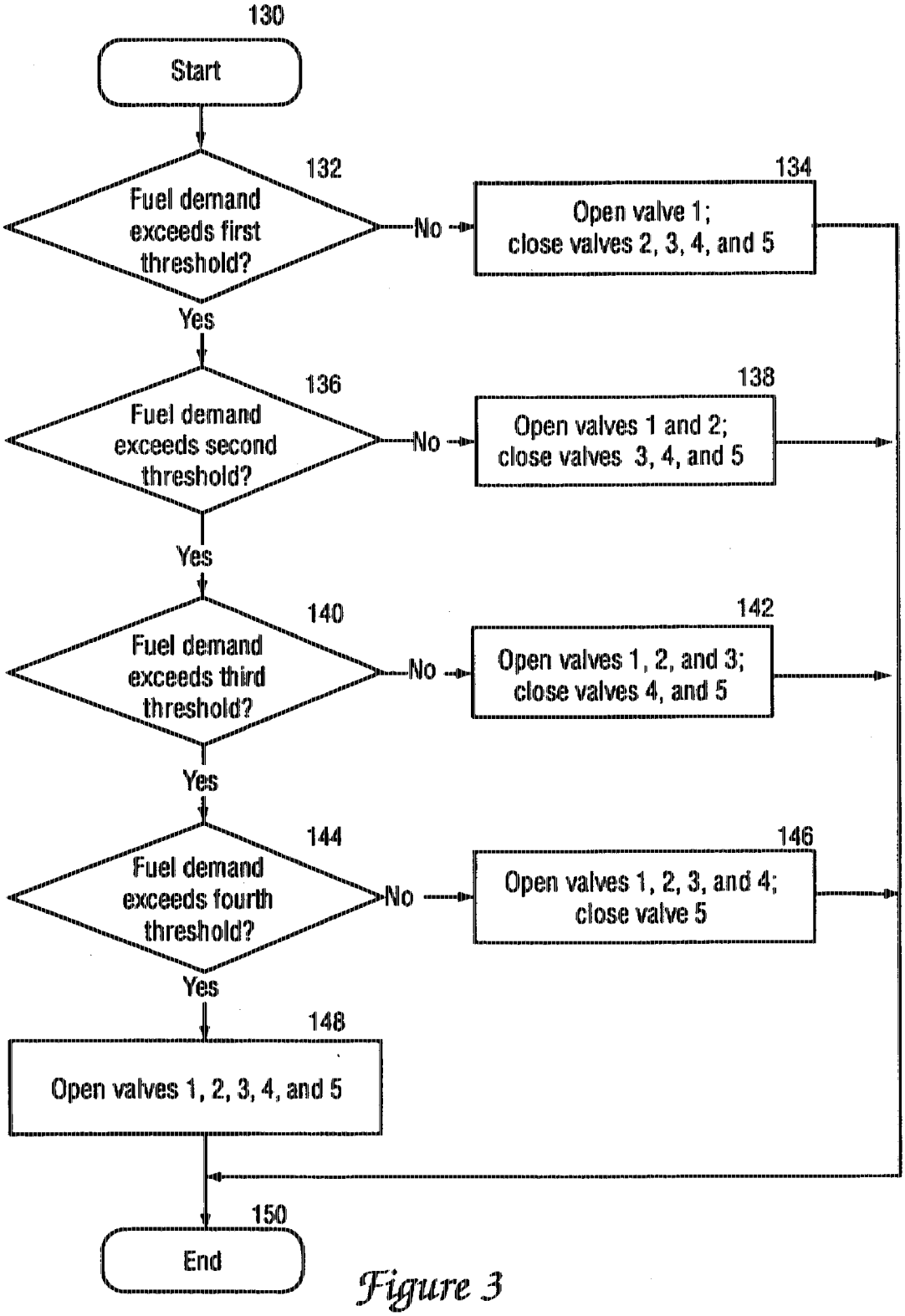
FIG. 3 is a high-level flowchart of the process of determining a valve configuration and setting a valve configuration in accordance with the method and system of the present invention.

With reference now to FIG. 3, there is depicted a high-level block diagram of the process of determining a current fuel demand and setting a valve configuration in accordance with the method and system of the present invention. As illustrated, the process begins at block 130 and thereafter passes to block 132 wherein the process determines whether or not current fuel demand exceeds a first reselected threshold demand. This determination may be made as shown at comparator 48 in FIG. 1. Comparator 48 may be implemented by an analog comparator, a digital comparator, or implemented in software. If current fuel demand does not exceed a first preselected threshold demand, the process configures the valves by opening valve V1, and closing valves V2, V3, V4, and V5, as illustrated at block 134.

If current fuel demand exceeds a first preselected threshold demand, the process determines whether or not current fuel demand exceeds a second preselected threshold demand, as depicted at block 136. If current fuel demand does not exceed a second preselected threshold demand, the process configures the valves by opening valve V1 and V2, and closing valves V3, V4, and V5, as illustrated at block 138.

If current fuel demand exceeds the second preselected threshold demand, the process determines whether or not current fuel demand exceeds a third preselected threshold demand, as depicted at block 140. If current fuel demand does not exceed a third preselected threshold demand, the process configures the valves by opening valves V1, V2, and V3, and closing valves V4 and V5, as illustrated at block 142.

If fuel demand exceeds the third preselected threshold demand, the process determines whether or not current fuel demand exceeds a fourth preselected threshold demand as depicted at block 144. If current fuel demand does not exceed the fourth preselected threshold demand, the process configures the valves by opening valves V1, V2, V3, and V4, and closing valve V5, as illustrated at block 146.

If present fuel demand exceeds the fourth preselected threshold demand, the process configures the valves by opening all valves V1 through V5 as depicted at block 148. Thereafter, the process of determining and setting a valve configuration ends, as illustrated at block 150.

While FIG. 3 describes the operation of a fluid heating apparatus having five valves, those persons skilled in the art should recognize another number of valves may be utilized. Also, the selection of preselected threshold demands should take into account the flow rate of the next valve to be opened once a corresponding threshold value is reached. For example, if a second threshold demand is much higher than a first threshold demand, the flow rate of the gas valve opened in response to the second threshold demand being met or exceeded should be much larger.

Figure 4:
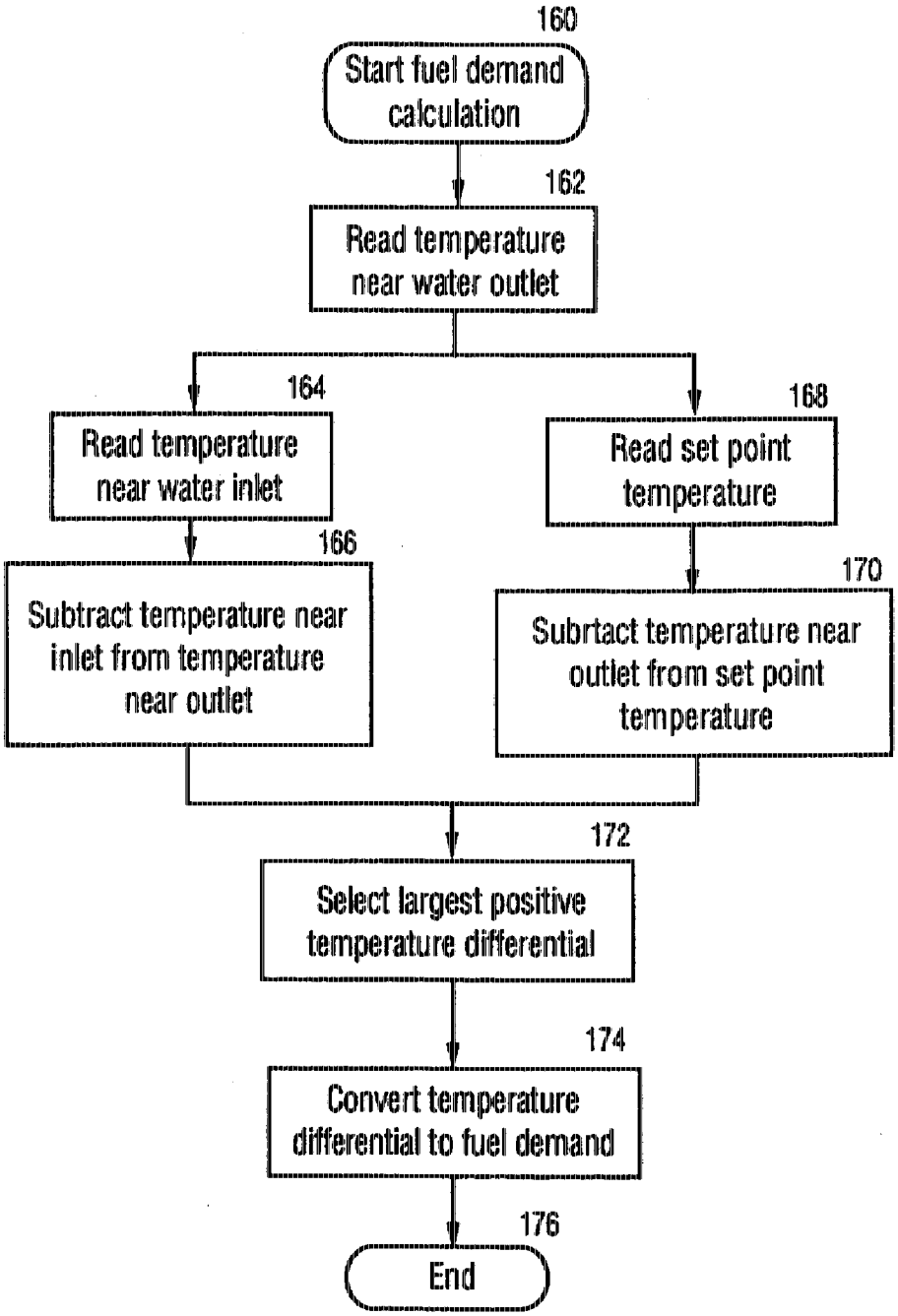
FIG. 4 is a high-level flowchart of the process of calculating heat demand in accordance with the method and system of the present invention.

Finally, with reference to FIG. 4, there is depicted a high-level flowchart illustrating the process of calculating fuel demand in accordance with the method and system of the present invention. As illustrated, the process begins at block 160 and thereafter passes to block 162 wherein the process reads a temperature nearer water outlet 28 (see FIG. 1). This may be accomplished by reading the temperature from outlet temperature probe 44 which, as described above, is placed closer to water outlet 28 than is inlet temperature probe 42. Next, the process reads the water temperature nearer water inlet 26, as depicted at block 164. This may be implemented by reading a temperature from inlet temperature probe 42. Thereafter, the process subtracts the temperature read nearer the inlet from the temperature read nearer the outlet, as depicted at block 166.

In a parallel operation, the process reads the set point temperature from set point input means 40, as illustrated at block 168. Then the process subtracts the temperature nearer the water outlet from the set point temperature, as depicted at block 170.

At this point, the process has calculated two temperature differences—one temperature calculated at block 166 and the other temperature difference calculated at block 170. The process then selects the largest positive temperature differential between the two calculated temperature differentials, as illustrated at block 172. Note that any negative temperature differentials resulting from the subtraction described in blocks 166 and 170 are ignored. Only positive temperature differentials are used in the demand calculation. Considering only the positive differential prevents the indication of fuel demand if the outlet temperature ever exceeds the set point temperature.

Next, the process performs any conversion that may be necessary to convert the temperature differential to a fuel demand signal that can be used by motor controller 24 or comparators 48 through 54 (see FIG. 1), as depicted at block 174. Such a conversion process may not be needed because the remaining portions of the system may operate in response to a temperature differential signal without needing any further signal conversions.

After any needed signal conversion, the process of calculating fuel demand ends, as illustrated at block 176. Those persons skilled in the art should note that the process for calculating fuel demand may be implemented in combinatorial logic, analog circuits, or in software running in demand calculator 38 as shown in FIG. 1.

The foregoing description of a preferred embodiment of the invention has been presented for the purpose of illustration and description. It is not intended to be exhaustive or limit the invention to the precise form disclosed. Obvious modifications or variations are possible in light of the above teachings. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A fluid heating apparatus comprising:

a fluid tank;

a combustion chamber communicating with the fluid tank for heat exchange;

a combustible fluid delivery system coupled to the combustion chamber, wherein the combustible fluid delivery system has multiple valves, each of which is operable in an off state and an on state for delivering combustible fluid to the combustion chamber in response to a valve signal;

for generating a heat demand signal;

means for generating a valve signal for each of the multiple valves in response to the heat demand signal, wherein each of the multiple valve signals sets a respective one of the multiple valves in either an off state or an on state in response to the heat demand signal;

wherein the fluid tank includes a fluid inlet and a fluid outlet, and wherein the means for generating a heat demand signal further includes:

an inlet temperature probe located in the fluid tank;

an outlet temperature probe located in the fluid tank nearer the fluid outlet than the inlet temperature probe; and means for determining the excess of a temperature measured by the outlet temperature probe over a temperature measured by the inlet temperature probe.

2. The fluid heating apparatus according to claim 1 wherein the means for generating a valve signal for each of the multiple valves comprises:

means for comparing the heat demand signal with a threshold demand for each of the multiple valves in the combustible fluid delivery system, wherein a valve on signal is produced in response to the heat demand signal being greater than or equal to the threshold demand and a valve off signal is produced in response to the heat demand signal being less than the threshold demand.

3. The fluid heating apparatus according to claim 1 further comprising:

an air blower coupled to the combustion chamber, wherein the air blower is operable in a plurality of modes for supplying air at a plurality of rates in response to the heat demand signal.

4. The fluid heating apparatus according to claim 1 wherein the valves of the combustible fluid delivery system are configurable in multiple configurations for supplying combustible fluids at multiple rates, and wherein the plurality of operating modes of the air blower are selected to supply air at stoichiometric rates for each of the rates of supplying combustible fluids with the multiple configurations of valves in the combustible fluid delivery system.

5. A fluid heating apparatus comprising:

a fluid tank;

a combustion chamber communicating with the fluid tank for heat exchange;

a combustible fluid delivery system coupled to the combustion chamber, wherein the combustible fluid delivery system has multiple valves, each of which is operable in an off state and an on state for delivering combustible fluid to the combustion chamber in response to a valve signal;

means for generating a heat demand signal;

means for generating a valve signal for each of the multiple valves in response to the heat demand signal, wherein each of the multiple valve signals sets a respective one of the multiple valves in either an off state or an on state in response to the heat demand signal;

wherein the combustible fluid delivery system includes at least one valve having a size selected to provide combustible fluid to the combustion chamber at a rate necessary to maintain a fluid temperature in the fluid tank when there is no demand for heated fluid.

6. A fluid heating apparatus comprising:

a fluid tank;

a combustion chamber communicating with the fluid tank for heat exchange;

a combustible fluid delivery system coupled to the combustion chamber, wherein the combustible fluid delivery system has multiple valves, each of which is operable in an off state and an on state for delivering combustible fluid to the combustion chamber in response to a valve signal;

means for generating a heat demand signal;

means for generating a valve signal for each of the multiple valves in response to the heat demand signal, wherein each of the multiple valve signals sets a respective one of the multiple valves in either an off state or an on state in response to the heat demand signal;

wherein the combustible fluid delivery system includes at least one valve having a size that exceeds a size that provides combustible fluid to the combustion chamber at a rate necessary to maintain a fluid temperature in the fluid tank when there is no demand for heated fluid.

7. A method for heating a fluid in a fluid heating apparatus having a fluid tank, a combustion chamber communicating with the fluid tank for heat exchange, and a combustible fluid delivery system coupled to the combustion chamber, wherein the combustible fluid delivery system includes a plurality of valves, said method comprising the steps of:

completely opening a first stage valve in the combustible fluid delivery system to supply combustible fluid to the combustion chamber at a first preselected fuel supply rate that maintains a fluid temperature in the fluid tank when there is no demand for heated fluid;

determining a demand for heat;

if the demand for heat equals or exceeds a first preselected threshold demand for heat, completely opening a second stage valve in the combustible fluid delivery system to supply combustible fluid to the combustion chamber at a second preselected fuel supply rate;

if the demand for heat equals or exceeds a second preselected threshold demand for heat, completely opening a third stage valve in the combustible fluid delivery system to supply combustible fluid to the combustion chamber at a third preselected fuel supply rate;

if the demand for heat is below a second preselected threshold demand for heat and the third stage valve is open, completely closing the third stage valve in the combustible fluid delivery system to supply combustible fluid to the combustion chamber at the second preselected fuel supply rate; and if the demand for heat is below a first preselected threshold demand for heat and the second stage valve is open, completely closing the second stage valve in the combustible fluid delivery system to supply combustible fluid to the combustion chamber at the first preselected fuel supply rate.

8. The method for heating a fluid in a fluid according to claim 7 wherein the fluid tank includes a fluid inlet and a fluid outlet, and wherein the step of determining a demand for heat includes:

reading an inlet temperature probe;

reading an outlet temperature probe, wherein the outlet temperature probe is located nearer the fluid outlet than the inlet temperature; and determining the excess of a temperature read from the outlet temperature probe over a temperature read from the inlet temperature probe.

9. The method for heating a fluid in a fluid according to claim 8 wherein the step of determining a demand for heat includes:

reading a preselected set point temperature; and determining the excess of the set point temperature over a temperature read from the outlet temperature probe.

10. The method for heating a fluid in a fluid according to claim 7 wherein the fluid heating apparatus includes an air blower coupled to the combustion chamber, further including the steps of:

operating the air blower to supply air to the combustion chamber at a first preselected air supply rate for supplying a stoichiometric volume of air in relation to the first preselected fuel supply rate;

if the demand for heat equals or exceeds a first preselected threshold demand for heat, operating the air blower to supply air to the combustion chamber at a second preselected air supply rate for supplying a stoichiometric volume of air in relation to the second preselected fuel supply rate;

if the demand for heat equals or exceeds a second preselected threshold demand for heat, operating the air blower to supply air to the combustion chamber at a third preselected air supply rate for supplying a stoichiometric volume of air in relation to the third preselected fuel supply rate;

if the demand for heat is below a second preselected threshold demand for heat and the third stage valve is open, operating the air blower to supply air to the combustion chamber at a second preselected air supply rate for supplying a stoichiometric volume of air in relation to the second preselected fuel supply rate; and if the demand for heat is below a first preselected threshold demand for heat and the second stage valve is open, operating the air blower to supply air to the combustion chamber at the first preselected air supply rate for supplying a stoichiometric volume of air in relation to the first preselected fuel supply rate.

* * * * *